US005957562A

United States Patent [19]

Hill

[11] Patent Number: 5,957,562

[45] Date of Patent: Sep. 28, 1999

[54] LIGHTING APPARATUS FOR A MODEL LIGHTHOUSE

[76] Inventor: Raymond Hill, 17107 Magnolia Dr., Hazel Crest, Ill. 60429

[21] Appl. No.: 09/059,535

[22] Filed: Apr. 13, 1998

[51] Int. Cl.[6] ..... F21V 33/00

[52] U.S. Cl. ..... 362/35; 362/286; 362/287; 362/253; 362/806; 446/477

[58] Field of Search ..... 362/35, 285, 286, 362/287, 418, 806, 253

[56] References Cited

U.S. PATENT DOCUMENTS

| | | | |
|---|---|---|---|
| 1,825,085 | 9/1931 | Neill . | |
| 2,636,314 | 4/1953 | Martinez | 46/12 |
| 4,081,666 | 3/1978 | Roehrick | 362/253 |
| 4,263,743 | 4/1981 | Hanson et al. | 46/228 |
| 4,318,159 | 3/1982 | Kaisner | 362/124 |
| 4,504,892 | 3/1985 | Zulfilar | 362/234 |
| 4,999,544 | 3/1991 | Cibor | 315/185 |
| 5,065,289 | 11/1991 | Teng | 362/101 |
| 5,211,469 | 5/1993 | Matthias et al. | 362/101 |
| 5,379,202 | 1/1995 | Daun | 362/252 |
| 5,394,309 | 2/1995 | Brown | 362/35 |
| 5,436,817 | 7/1995 | Wotton | 362/267 |
| 5,439,407 | 8/1995 | Friedel | 446/219 |
| 5,526,243 | 6/1996 | Masters | 362/122 |
| 5,584,571 | 12/1996 | Chandler et al. | 362/295 |
| 5,597,228 | 1/1997 | Boyle | 362/101 |
| 5,613,764 | 3/1997 | O'Brien | 362/252 |

*Primary Examiner*—Thomas M. Sember
*Attorney, Agent, or Firm*—Gene Scott-Patent Law & Venture Group

[57] ABSTRACT

A lighting apparatus for a model lighthouse provides a lighting effect similar to that of a commercial lighthouse. In one embodiment a lamp is rotationally driven. In another embodiment a lighting means for extending a stationary lamp is taught so as to accommodate various size lighthouse models. In a still further embodiment, a combination of rotational and extension features are provided.

9 Claims, 5 Drawing Sheets

46
48
70
56
51
58
50
56
44
54
60
43
50N
52
4
4
80
90
20

LIGHTING APPARATUS FOR A MODEL LIGHTHOUSE

BACKGROUND OF THE INVENTION

1. Field of the Invention

This invention relates generally to an apparatus for lighting a toy or scale replica, and more particularly to such an apparatus for producing a lighting affect for a scale lighthouse model.

2. Description of Related Art

The following art defines the present state of this field:

Martinez, U.S. Pat. No. 2,636,314 describes a toy lighthouse is a somewhat fanciful reproduction of an existing lighthouse found on an island in the South Pacific. The outward configuration of the device is therefore highly appealing. The toy may be readily constructed from suitable insulating plastic material for the major portions thereof, while suitable conductive metal is used for the operative electrical circuits.

Kaisner, U.S. Pat. No. 4,318,159 describes A lamp fixture comprising a first figurine mounted to a base and a second figurine connected relative to the base by means of a flexible member. A first lamp socket and a lamp shade are disposed at the top of a lamp pole. A second lamp socket is disposed within the interior of the first figurine. Movement of the second figurine to a first and a second position actuates an electrical circuit which supplies household current via a power cord to the first and the second lamp sockets, respectively, to light lamp bulbs contained therein. The electrical circuit comprises reed switches which are actuated by a magnet disposed within the second figurine. Each reed switch triggers a thyristor such as a triac or two silicon controlled rectifiers connected in parallel to provide a path for the household current to flow to the respective lamp socket. Movement of the second figurine to a neutral position precludes the household current from foregoing abstract is merely a resume of one general application, is not a complete discussion of all principles or operation or applications, and is not to be construed as a limitation on the scope of the claimed subject matter.

Chandler et al., U.S. Pat. No. 5,584,571 relates to an apparatus for simulating lighting effects such as an illumination effect necessary to simulate a real life effect for an ornamental display. More specifically, the present invention relates to a light effect which undergoes a number of readily discernable illumination intensities so as to create an illusion of a rotating light beacon which may be used in connection with a lighthouse, control tower, search light or the like. The present invention is quite durable and reliable and economically manufactured an may be positioned readily within a model display.

Boyle, U.S. Pat. No. 5,597,228 describes an aquarium landscape system provides a landscape partition enabling the creation of multiple different terrain levels within the aquarium. An internal illumination system is shown having a light assembly underneath the glass bottom of the aquarium and light carrying tubes within the aquarium for carrying the light from the bottom of the tank to the bottom of one or more of the decorative structures within the tank, thereby internally illuminating the decorative structure. In another embodiment of the invention, the exterior surface of the decorative structures within the aquarium is illuminated with a spot light effect. The color of the internal and exterior illumination of the decorative structures can be changed individually for each structure, or can be changed for all structures.

Hanson et al., U.S. Pat. No. 4,263,743 describes a novelty toy in the shape of a skull includes a cranial shaped housing and a pivotal jaw portion. The jaw is biased to a closed position by a biasing element and includes a grip portion to be gripped by the user of the device to more the jaw to an open position. A depending handle is also defined on the skull to allow the skull to be supported by the user. A pair of lights are mounted in the eye apertures and reflectors are rotatably mounted within the apertures surrounding the light bulbs. A gear train connects the reflectors to a manually operated gear to allow rotation of the reflectors within the housing. Each reflector includes a colored lens that may be rotated in front of the light to provide a different appearance to the toy. The lights are connected through a switch mounted within the housing to a portable power source. The switch includes a plurality of positions for producing alternate lighting or flashing effects.

Roehrick, U.S. Pat. No. 4,081,666 describes an ornamental lighting device to be used on the terraneous shelf of an ecolarium, ecology tank, (two-tiered aquarium) simultaneously providing light for the aqueous area underneath the terraneous shelf and ornamental lighting effects of the garden area of the terraneous shelf. The device having an easily removable cap containing a light socket, a male connector, the base containing light and heat vents and a downward light vent also the female electrical connector.

O'Brien, U.S. Pat. No. 5,613,764 describes an internally illuminated decorative object includes an electric light including a lamp socket and light bulb replacably mounted in the lamp socket. The electric light is supported on a support member that has at least one through opening for the passage of the light bulb therethrough from its first to its second side. A flat translucent image-bearing member is mounted on the support member so as to be at least coextensive with the second side of the support member for illumination by the light bulb when the latter is lit as electric current is supplied to it. The support member has a central portion and two wings flanking the central portion and connected to the image-bearing member by respective lugs that pass through associated slots of the image-bearing member. The central portion of the support member includes a wall that extends along an arcuate course and two end walls situated at vertically spaced end regions of the arcuate wall as considered in a condition of use of the object and rigidly connected with the wall to maintain it in substantial conformity with the arcuate course. The wings are connected to the central portion of the support member by respective vertically extending hinge regions as considered in the use condition for pivoting about the hinge regions at least as the decorative object is being assembled.

Daun U.S. Pat. No. 5,379,202 describes partially overlapping display elements have light string sets mounted thereon and sequentially illuminated to simulate animation of a decorative part of an outdoor light display.

Matthias et al., U.S. Pat. No. 5,211,469 describes an aquarium lighting system for underwater illumination of an aquarium tank. The light sources each include an elongated insulated wire having a light emitting diode on one end. A water impervious encapsulating layer of material extends over the LED lens and preferably seals and electrically insulates the connection between the elongated wire and the light emitting diode. The wire insulation is both waterproof and watertight. The plug has an opening extending therethrough which cooperates with an attachment mechanism such as a tie wrap or a suction cup to facilitate attaching the light emitting diode to either an object within the tank or the tank walls. A decorative aquarium volcano and display stand also are shown.

Teng, U.S. Pat. No. 5,065,287 describes a display device includes a crystal ball fixed on a base formed with plural concave and convex portions on a spherical surface of the crystal ball to respectively form plural concave lens and convex lens on the ball surface when filled with water in the ball as viewed through the concave and convex portions for enhancing decorative interest.

Cibor, U.S. Pat. No. 4,999,544 describes a dimmer device adapted to enable conveniently accessed control over the intensity of illumination of Christmas tree lights, in which a housing for the dimmer device is enclosed in a housing in an ornamental cover piece, and which is provided with a hook to allow the device to hang on a branch in an exposed position.

Zulfilar, U.S. Pat. No. 4,504,892 describes improved visual effects which are quite pleasing are obtained by illuminating paintings with a lighting system comprising at least two light sources directed on the art work from in front and above, and in front and to the side, respectively, with at least one of the light sources varied in intensity from a maximum to a minimum amount of illumination when the one light source reaches its minimum.

Brown, U.S. Pat. No. 5,394,309 describes a submersible device for changing colors in an aquarium comprising of a base member of a rigid construction and heavy weighted material to allow placement in the bottom of an aquarium. A housing having a lower surface coupled to the base with upstanding side walls and a cover piece with a dome-like top formed with clear transparent windows therethrough to define a chamber therewithin, the chamber including an upwardly extending post at a central extent thereof coaxial with the axis of top. A driven gear having a circular extent in a horizontal place within the chamber and having teeth around the periphery thereof, gear being mounted on the post for rotation with respect thereto. A submersible motor mounted within the chamber having a drive-gear rotatable about a vertical axis with teeth in contact with the teeth of the driven gear for rotating and imparting rotation to the driven gear. A fixed light source mounted within the chamber above the post. A domed member mounted above and to the driven gear for rotation therewith at a location above the light source, the domed member being provided with a plurality of transparent plates of varying colors.

Neill, U.S. Pat. No. 1,825,085 relates to lamps and particularly to reading lamps. The principal object of the invention is to devise a reading lamp having the parts constructed and assembled in a novel manner so that the lamp may be made to resemble a miniature lighthouse with a low light shining through the lens, and a bright light for reading thrown downwardly which will not be visible to an observer viewing the lamp from the side. A further object of the invention is to devise a reading lamp which presents a particularly realistic representation of a miniature lighthouse, and which throws a bright light downwardly for reading, but has the parts arranged so that the reading light feature of the lamp will not interfere with the realistic appearance of the miniature lighthouse.

Finally, a lighthouse beacon product is being made commercially available by the G.Z. Lefton Co. under the trade name "Authentic Lighthouse Beacons with Transformer."

This product is not marked "patented" or "patent pending." It consists of a base portion with snap-in mounting, a telescoping rod with a light bulb at its terminal end, and a rubber washer for light sealing a projection room of a model lighthouse. This product was introduced into the U.S. marketplace sometime after the date of the instant invention.

The prior art teaches lighting apparatus for various toys and other miniature items including a model lighthouse. However, the prior art does not teach such an apparatus having a lamp capable of being adjusted in length and of lamp rotation, thereby providing a lighting effect very similar to a commercial lighthouse. The present invention fulfills these needs and provides further related advantages as described in the following summary.

SUMMARY OF THE INVENTION

The present invention teaches certain benefits in construction and use which give rise to the objectives described below.

The present invention provides a lighting apparatus for a scale lighthouse, the apparatus being novel in various aspects as described below and capable of providing an effect similar to that of commercial lighthouses. In one embodiment of the present invention a lighting effect is provided for driving a lamp in a rotational manner similar to a true lighthouse function. In another embodiment a means for extending a stationary light is taught so as to accommodate various size lighthouse models. In a still further embodiment, a combination of rotational and extension features are provided.

A primary objective of the present invention is to provide a lighthouse model with real appearance and lighting effects, having advantages not taught by the prior art.

Another objective is to provide such an effect that may be adjusted for length so as to adapt to various models in the market.

A further objective is to provide such an effect that may be adjusted for length as well as provide rotation.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
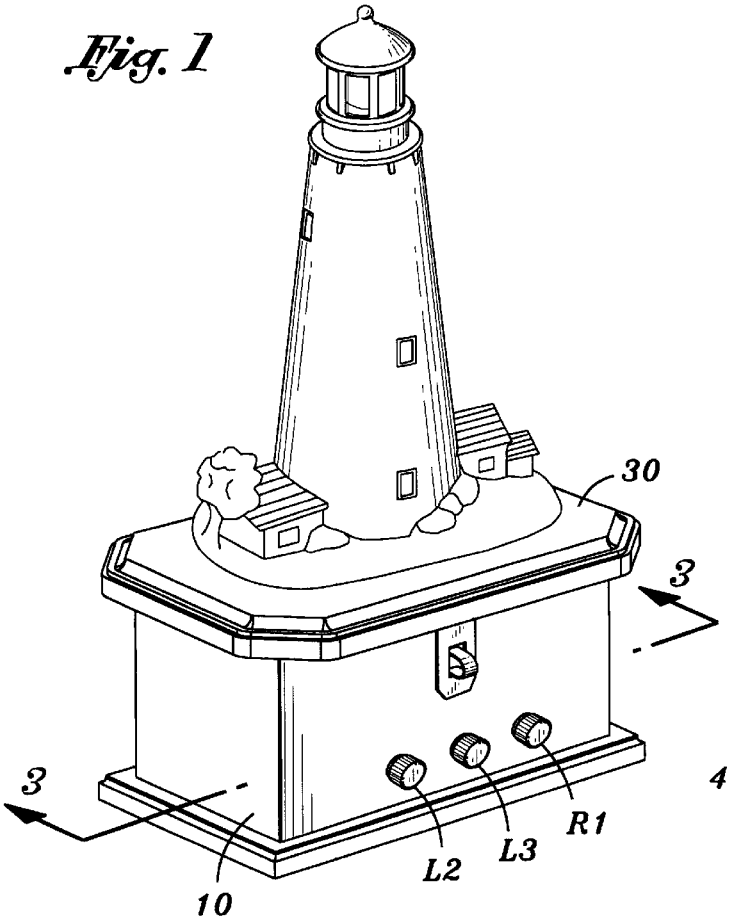
FIG. 1 is a perspective front elevational view of the preferred embodiment of the present invention.
Figure 2:
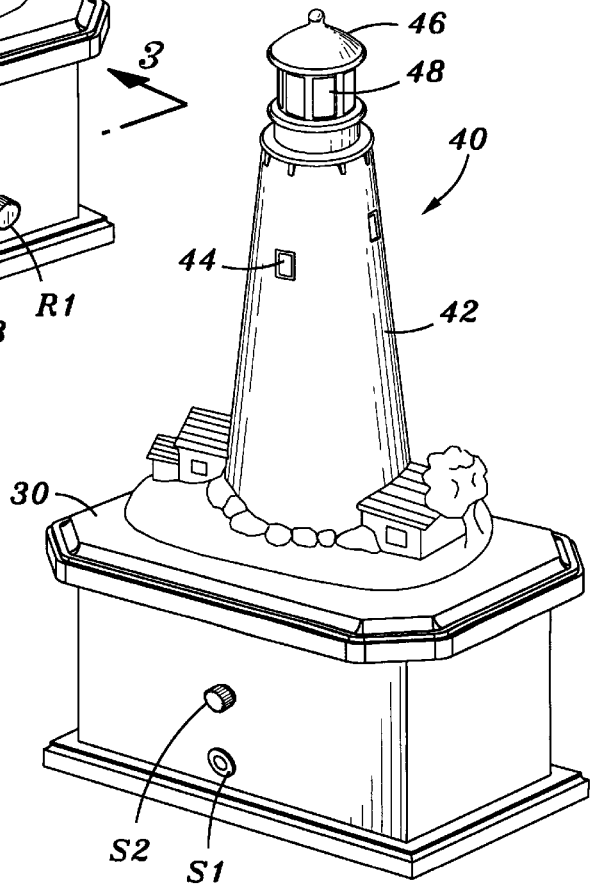
FIG. 2 is a perspective rear elevational view thereof.
Figure 6:
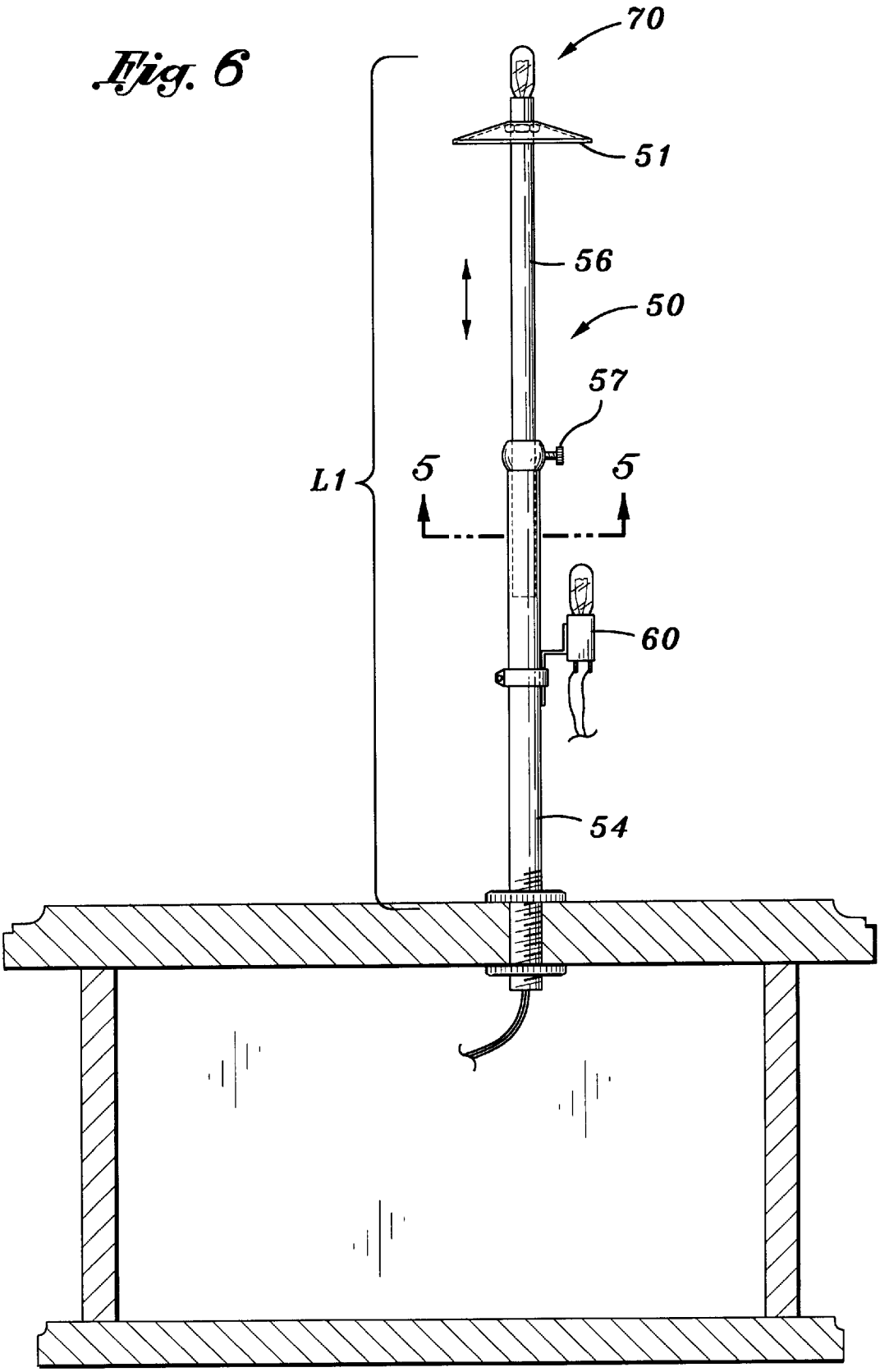
FIG. 6 is a view similar to FIG. 3 but showing portions in alternate embodiment wherein a lamp is vertically adjustable.

The above described drawing figures illustrate the invention, a model lighthouse apparatus comprising a box structure 10, as best seen in FIGS. 1 & 2, providing an interior space 20 (FIG. 3) enclosed within the box structure 10 and an upwardly facing top mounting plate 30; a scale model hollow lighthouse structure 40 (FIG. 2) fixed to the mounting plate 30 and extending upwardly therefrom, the lighthouse structure 40 providing a lighthouse tower 42 with a tower window means 44 therein, and atop the lighthouse tower 42, a beacon room 46 with a beacon room window means 48 therein; a elongate and linear lighting boom 50 fixed at a proximal end 52 thereof to the top mounting plate 30 and extending upwardly therefrom within the lighthouse structure 40, the lighting boom 50 comprising a first tube means 54 engaged with a second tube means 56 such that a length L1 of the joint first and second tube means is extensible, as shown in FIG. 6; a tower lamp means 60 joined medially to the lighting boom 50 and positioned so as to illuminate the interior 43 of the lighthouse tower 42 and the tower window means 44; and a beacon room lamp means 70 joined to a distal end 58 of the lighting boom 50 and positioned so as to illuminate the interior of the beacon room 46 and the beacon room window means 48.

The first 54 and second 56 tube means are preferably telescopically joined as shown in FIG. 6, and further provide a means for fixing 57 the length L1 thereof, such as the screw shown, the lighting boom 50 coaxially incorporating an electrical power line 59 therewithin (FIG. 5) for conducting power from the box structure 10 to the beacon room lamp means 70.

Preferably, an opaque shading washer 51 is frictionally joined near the distal end 58 of the lighting boom 50, and adapted in size, shape and material, as shown, to functionally exclude light exchange between the lighthouse tower 42 and the lighthouse beacon room 46. Washer 51 is preferably made of a disk shaped rubber material so that it may be forced to comply in shape to any surface against which it is pressed. In this manner, the light within the tower 42 can be adjusted as to brightness independently from that of the beacon room 46 as in a conventional lighthouse.

In one embodiment of the invention, as seen in FIG. 6, the electrical boom 50 is adjustable in length to match the corresponding dimension of the lighthouse structure 40. The appropriate length of the electrical power line 59 being drawn from or into the interior space 20 of box structure 10 as necessary to satisfy the adjusted boom length L1. It is shown, here, that the tubes 54 and 56 are easily moved one within the other and fixed in total length by fixing means 57.

Figure 3:
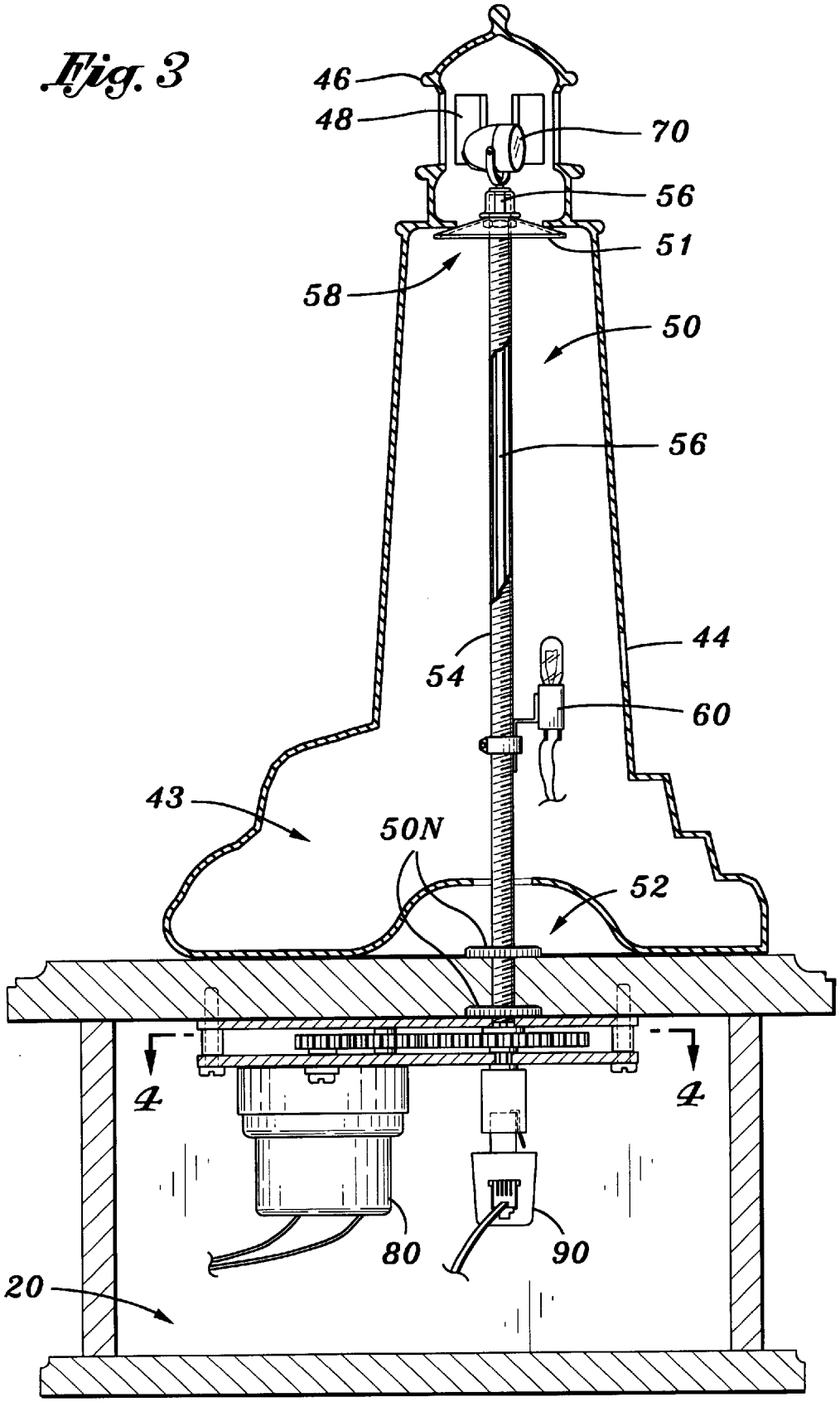
FIG. 3 is a full sectional view thereof taken along line 3—3 in FIG. 1 and showing an embodiment for rotating a lamp.
Figure 5:
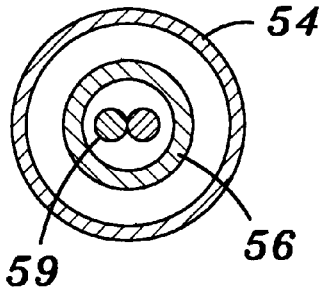
FIG. 5 is a partial sectional view thereof taken along line 5—5 in FIG. 6.
Figure 4:
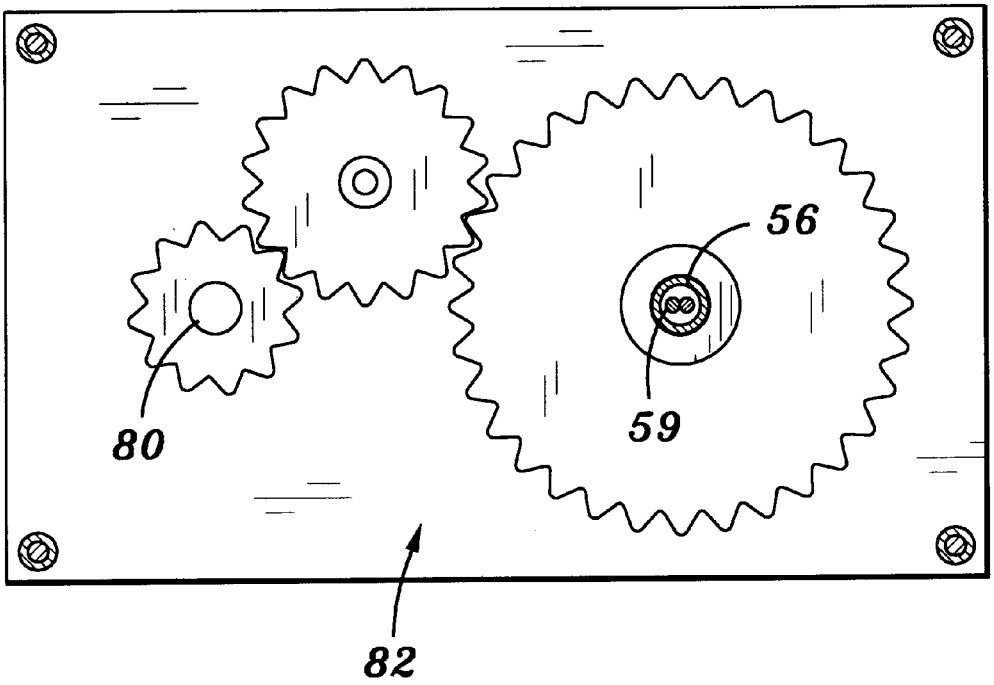
FIG. 4 is a partial sectional view thereof taken along line 4—4 in FIG. 3.

In another embodiment of the invention, as seen in FIG. 3, the second tube means 56 is rotationally driven by a prime mover 80 mounted within the box structure 10, i.e., second tube means 56 is functionally mounted to prime mover 80, as shown in FIG. 4 and is free to rotate therewith. First tube means 54 is fixed in place and is supported by nuts 50N which are threaded onto first tube means 54, as shown. FIG. 5 also clearly shows such an arrangement, where, preferably, second tube means 56 and electrical power line 59 rotate together within stationary first tube means 54. Washer 51 is preferably mounted on stationary first tube means 54 so as to remain stationary, while lamp means 70 is mounted at the end of second tube means 56 so as to rotate therewith.

Figures 7, 8:
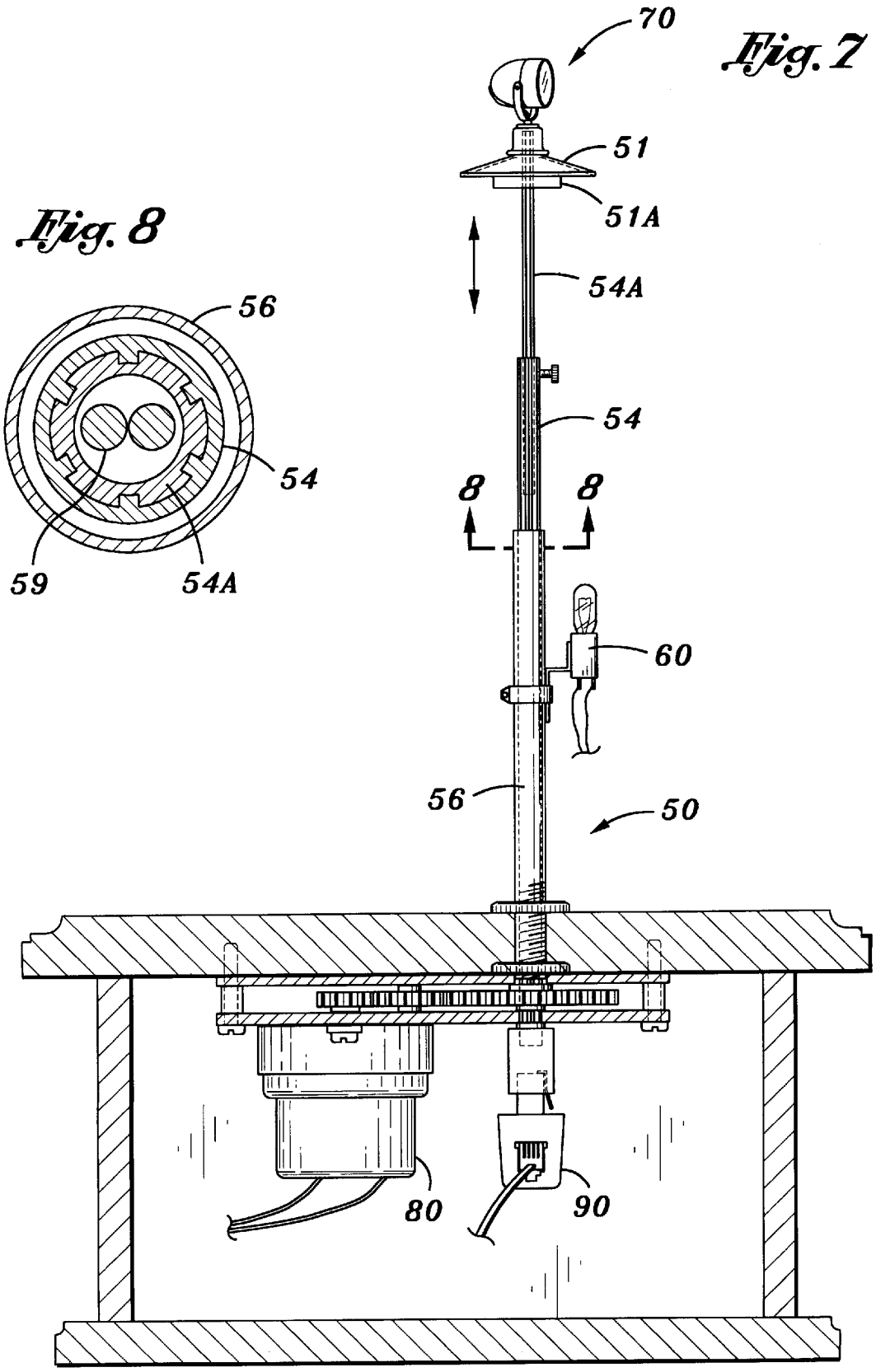
FIG. 7 is a view similar to FIG. 3 showing portions of a still further embodiment wherein a lamp is rotatable as well as vertically adjustable.
FIG. 8 is a partial sectional view taken along line 8—8 in FIG. 7.

In a still further embodiment of the invention, as shown in FIGS. 7 and 8, both the adjustment of length L1 as well as rotation of beacon room lamp means 70 are combined. To accomplish this, a third tube means 54A is slidably engaged with second tube means 54 such as by the engaging spline shown, or similar means, so that both tube means 54 & 54A are forced to rotate together, but tube means 54A is telescopically positionable relative to tube means 54 so as to adjust length L1. The connection of electrical power to a rotating member is well known in the art, and is accomplished here, through the use of a rotational electrical power coupler 90 such as the type commonly used to prevent telephone handset wires from becoming wound up or snarled. Such a coupler 90 is preferably used at the proximal end 52 (FIG. 7) of the lighting boom 50 for conducting power to the electrical power line 59. In this embodiment, washer 51 is mounted onto bearing race assembly 51A so as to remain stationary although tube means 54A is rotating. Clearly, lamp means 70 is secured to tube assembly 54A so as to rotate therewith.

In use, the lighting boom 50 is adjusted to the necessary length L1 for any particular lighthouse structure 40 and is fitted therein with nuts 50N holding boom 50 tightly to mounting plate 30. Length L1 is set so that beacon room lamp means 70 is positioned opposite to beacon room window means 48, and directed as shown in FIG. 3 for throwing light directly out of window means 48 as with a commercial lighthouse. Lamp means 60 may be adjusted and positioned to be opposite window means 44, but may be place away from window means 44 for achieving indirect light effects in the tower. Both lamp means 60 and 70 are interconnected by wires to a power supply means (not shown) in interior space 20, and may comprise a battery, or a DC rectification and transformer means, as is well known in the art. Prime mover 80 is preferably a timer type motor and is adapted for appropriate speed reduction through the use of gear means 82, shown in FIG. 4. Phase speed control or rheostat speed control may be used to adjust the rotational speed of lamp means 70. Likewise, phase control or a resistor divider network may be used, for example to adjust lamp intensities as is well known in the art. When external power is used, a socket S1 (FIG. 2) is supplied for accepting an incoming jack (not shown). Many configurations of control may be applied to the present invention such as shown in FIGS. 1 and 2. In FIG. 1 socket S1 is shown as well as an on-off switch S2. For the rotational embodiment, in FIG. 1, L2 and L3 adjust the brightness of lamp means 60 and 70 respectively, while R1 adjusts the rotational rate of lamp means 70 through prime mover 80. For the non-rotational embodiment, R1 adjusts the rate of a strobe device so that lamp means 70 goes through an illumination cycle from full off to full bright and then back to full off in a repeating fashion in order to simulate a rotating beacon. Electrical circuits for the accomplishment of the above control are so well known in the art as to be unnecessary to describe here in further detail. Such circuits may be easily fitted into and mounted within interior space 20.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A model lighthouse apparatus comprising:

a box structure providing an interior space enclosed within the box structure and an upwardly facing top mounting plate;

a scale model lighthouse structure fixed to the mounting plate and extending upwardly therefrom, the lighthouse structure providing a lighthouse tower with a tower window means therein, and atop the lighthouse tower, a beacon room with a beacon room window means therein;

a linear lighting boom fixed at a proximal end thereof to the top mounting plate and extending upwardly therefrom within the lighthouse structure, the lighting boom comprising a first tube means engaged with a second tube means such that a length of the joint first and second tube means is extensible;

a tower lamp means joined medially to the lighting boom and positioned so as to illuminate the interior of the lighthouse tower and the tower window means;

a beacon room lamp means joined to a distal end of the lighting boom and positioned so as to illuminate the interior of the beacon room and the beacon room window means.

2. The apparatus of claim 1 wherein the first and second tube means are telescopically joined and further provide a means for fixing the length thereof, the lighting boom coaxially incorporating an electrical power line therewithin for conducting power from the box structure to the beacon room lamp means.

3. The apparatus of claim 1 further including an opaque shading washer frictionally joined near a distal end of the lighting boom, and adapted in size and shape to functionally exclude light exchange between the lighthouse tower and the lighthouse beacon room.

4. A model lighthouse apparatus comprising:

a box structure providing an interior space enclosed within the box structure and an upwardly facing top mounting plate;

a scale model lighthouse structure fixed to the mounting plate and extending upwardly therefrom, the lighthouse structure providing a lighthouse tower with a tower window means therein, and atop the lighthouse tower, a beacon room with a beacon room window means therein;

a linear lighting boom comprising a first tube means fixed at a proximal end thereof to the top mounting plate and extending upwardly therefrom within the lighthouse structure, a second tube means being coaxially positioned within the first tube means, the second tube means being rotationally driven by a prime mover within the box structure;

a tower lamp means joined medially to the lighting boom and positioned so as to illuminate the interior of the lighthouse tower and the tower window means;

a beacon room lamp means joined to a distal end of the lighting boom and fixed to rotate with the second tube means and positioned so as to illuminate the interior of the beacon room and the beacon room window means.

5. The apparatus of claim 4 wherein the lighting boom coaxially incorporates an electrical power line therewithin for conducting power from the box structure to the beacon room lamp means.

6. The apparatus of claim 4 further including an opaque shading washer frictionally joined near a distal end of the lighting boom, and adapted in size and shape to functionally exclude light exchange between the lighthouse tower and the lighthouse beacon room.

7. A model lighthouse apparatus comprising:

a box structure providing an interior space enclosed within the box structure and an upwardly facing top mounting plate;

a scale model lighthouse structure fixed to the mounting plate and extending upwardly therefrom, the lighthouse structure providing a lighthouse tower with a tower window means therein, and atop the lighthouse tower, a beacon room with a beacon room window means therein;

a linear lighting boom comprising a first tube means fixed at a proximal end thereof to the top mounting plate and extending upwardly therefrom within the lighthouse structure, a second tube means and a third tube means being coaxially positioned within the first tube means, the second tube means being rotationally driven by a prime mover within the box structure, the third tube means being telescopically engaged with the second tube means;

a tower lamp means joined medially to the lighting boom and positioned so as to illuminate the interior of the lighthouse tower and the tower window means;

a beacon room lamp means joined to a distal end of the lighting boom and fixed to rotate with the third tube means and positioned so as to illuminate the interior of the beacon room and the beacon room window means.

8. The apparatus of claim 7 wherein the lighting boom coaxially incorporates an electrical power line therewithin for conducting power from the box structure to the beacon room lamp means and further comprising a rotational electrical power coupler means engaged at the proximal end of the lighting boom for conducting power to the electrical power line.

9. The apparatus of claim 7 further including an opaque shading washer mounted onto a bearing assembly, the bearing assembly joined near a distal end of the lighting boom so as to fixedly position the shading washer to functionally exclude light exchange between the lighthouse tower and the lighthouse beacon room.

* * * * *